United States Patent [19]

Zhukovsky et al.

[11] 4,430,441

[45] Feb. 7, 1984

[54] COLD SETTING SAND FOR FOUNDRY MOULDS AND CORES

[76] Inventors: Sergei S. Zhukovsky, ulitsa Profsojuznaya 17, korpus 1, kv. 15; July M. Junovich, ulitsa Veshnyakovskaya, 11, korpus 1, kv. 201; Viktor N. Pertsovsky, ulitsa Ordzhonikidze, 6"A", kv. 5; Vyacheslav S. Kolesnikov, Volgogradsky prospekt, 145/8, kv. 117, Moscow; Igor P. Renzhin, ulitsa Kalinina, 72, kv. 12, Sverdlovsk; Semen I. Rivkin, Kolpino, Pavlovskaya, 84, kv. 46, Leningrad, all of U.S.S.R.

[21] Appl. No.: 342,011

[22] PCT Filed: May 30, 1980

[86] PCT No.: PCT/SU80/00095

§ 371 Date: Jan. 18, 1982

§ 102(e) Date: Jan. 18, 1982

[87] PCT Pub. No.: WO81/03445

PCT Pub. Date: Dec. 10, 1981

[51] Int. Cl.[3] ..... C04B 35/04

[52] U.S. Cl. ..... 501/109; 501/110; 501/123; 501/133

[58] Field of Search ..... 501/109–111, 501/116, 123, 133; 106/38.2, 38.24

[56] References Cited

U.S. PATENT DOCUMENTS

| | | | |
|---|---|---|---|
| 2,614,050 | 10/1952 | Rusoff | 501/109 |
| 3,030,216 | 4/1962 | Chantler et al. | 501/109 |
| 3,879,208 | 4/1975 | Cassens | 501/109 |
| 4,183,759 | 1/1980 | Epstein | 106/38.2 |
| 4,312,671 | 1/1982 | Williame | 106/38.2 |

*Primary Examiner*—James Poer

*Attorney, Agent, or Firm*—McAulay, Fields, Fisher, Goldstein & Nissen

[57] ABSTRACT

A cold setting sand for moulds and cores comprises a refractory filler and an acid, wherein the acid used is organic acid with the dissociation constant of $10^{-5}$ to $10^{1}$, with the components being contained therein in the following amounts, in percent by weight:

| | |
|---|---|
| refractory filler | from 95 to 99 |
| organic acid | from 1 to 5. |

20 Claims, No Drawings

COLD SETTING SAND FOR FOUNDRY MOULDS AND CORES

BACKGROUND OF THE INVENTION

The present invention relates to foundry practice and more in particular to a cold setting sand for foundry moulds and cores.

There is known a foundry sand which comprises a refractory filler containing magnesium and/or chromium oxides, such as chrome-magnesite or magnesite-chrome, and a binder such as alcohol-sulfite lye or water glass (A. M. Liass, "Fast Setting Foundry Sands", Mashinostroenie Publishers, Moscow, 1965).

There is also known a cold setting sand which comprises a filler, orthophosphoric acid and a powdered material containing iron oxides.

The prior art sands are disadvantageous in that they are difficult to shake out, have insufficient strength, and require heat drying. Furthermore, the powder material containing iron oxides requires pregrinding, which makes the production more complicated and expensive, and damages to cores during their removal from core-boxes and subsequent handling.

DISCLOSURE OF THE INVENTION

What is required to a cold setting sand for moulds and cores of such composition having high strength, and not requiring heat drying and pregrinding of the starting materials.

The invention provides a cold setting sand for foundry moulds and cores, comprising a refractory filler and an acid, wherein the acid used is an organic acid with a dissociation constant of $10^{-5}$ to $10^{1}$, the components being contained therein in the following amounts, percent by weight:

| | |
|---|---|
| refractory filler | from 95 to 99 |
| organic acid | from 1 to 5 |

A decrease in the amount of organic acid below 1.0 percent by weight will make it impossible to prepare a sand of the required strength, whereas an increase of this amount above 5.0 percent by weight will have no substantial effect on the sand properties.

The foundry sand of the invention lends itself readily for the knocking-out operation, has high strength and rapid setting rates, and requires no heat drying.

The refractory filler used in the sand of the invention is preferably magnesium oxides, and/or chromium oxides, and/or iron oxides, and/or silicon oxides, and the organic acid with the dissociation constant of $10^{-5}$ to $10^{1}$ is preferably an aromatic sulfonic acid or carboxylic acid.

Such selection of fillers and acids makes it possible to produce a cold setting sand of good technological properties.

Preferably, the cold setting sand of the invention additionally comprises orthophosphoric acid taken in a ratio to organic acid as 0.1:1 to 4:1.

The above organic acid/orthophosphoric and ratio of 1:0.1 to 1:4 permits the sand setting rates to be regulated in accordance with various production conditions. A lower content of orthophosphoric acid will have no effect on the technological properties of the sand, whereas a higher content will bring down the sand setting rate to an inadmissibly low level.

BEST MODE FOR CARRYING OUT THE INVENTION

According to the invention, the cold setting sand is prepared by stirring a mixture of the refractory filler and acid for 1–2 min.

The acid is preferably introduced undiluted, or in solution. In the latter case, the total amount of solution should be increased so that the content of acid as calculated for the undiluted acid will be within the range of 1 to 5.0 percent by weight.

The sand of the invention may be prepared both with the use as the filler of pure oxides of magnesium, and/or chrome, and/or iron, and/or silicon, or materials containing these oxides, for example, magnesite, chrome-magnesite, magnesite-chrome or a mixture thereof. The above-mentioned oxides or materials containing them can be also used in combination with other refractory fillers, such as quartz sand, zircon, kyanite-sillimanite, etc.

The aggregate content of the above-mentioned oxides in the refractory filler should be in the range of from 2.0 to 100 percent by weight.

Table 1 gives, as an example, the chemical composition of chrome-magnesite, magnesite-chrome and chrome ironstone, which are used as the refractory filler in the cold setting sand of the invention.

TABLE 1

| | Chemical composition, % | | | | | | | |
|---|---|---|---|---|---|---|---|---|
| Filler | MgO | $Cr_2O_3$ | $Al_2O_3$ | FeO | $Fe_2O_3$ | $SiO_2$ | CaO | The rest |
| Magnesite-chrome | 62–71 | 9–17 | 3–7 | — | 4–7 | 3–7 | 3–6 | 0.3–8.8 |
| Chrome-magnesite | 51–57 | 18–22 | 5–7 | — | 7–10 | 3–5 | 3–4 | 0.3–9.8 |
| Chrome ironstone | 14–18 | 52–58 | 8–10 | 11–14 | — | 2–5 | — | 0.9–1.1 |

The rate of setting and strength of the sand may be regulated by altering the granulometric composition of oxides. Therefore, the sand composition should include such oxides in which the amount of fractions having less than 0.1 mm in size ranges from 5.0 to 100.0 percent by weight. The use of oxides with a lower amount of such fractions adversely affects the rate of setting and strength of the sand. An increase in the amount of small-size fractions (below 0.1 mm) results in higher setting rates and strength of the sand.

Table 2 gives the granulometric composition of the oxides used in the sand composition.

TABLE 2

| No. | Filler | Mesh size 2.5 | 1.6 | 1.0 | 0.63 | 0.4 | 0.315 | 0.2 | 0.16 | 0.1 | 0.063 | 0.05 | 0.05 | Clay component, % |
|---|---|---|---|---|---|---|---|---|---|---|---|---|---|---|
| | | Sieve residue, % | | | | | | | | | | | | |
| 1 | Magnesite-chrome | 1.4 | 4.38 | 10.96 | 12.4 | 15.76 | 7.28 | 11.2 | 8.32 | 10.68 | 10.26 | 2.86 | 0.66 | 3.84 |
| 2 | Chrome-magnesite | — | 0.08 | 2.44 | 6.92 | 11.0 | 9.7 | 6.42 | 6.20 | 7.85 | 10.58 | 5.90 | 19.0 | 13.44 |
| 3 | Chrome ironstone | 1.2 | 3.16 | 4.57 | 8.71 | 19.8 | 11.42 | 9.23 | 7.84 | 12.56 | 11.66 | 3.29 | 5.34 | 1.22 |

Standard samples were made from the sand by charging the latter into blocks and its subsequent compacting. The samples were then tested for compressive strength (in kg/cm$^2$).

The knocking-out characteristic is determined by the residual strength of the sand at high temperatures, found after heating and cooling the sand samples.

The invention is further described by the following illustrative Examples.

EXAMPLE 1

A sand was prepared from the following components, in percent by weight:

| | |
|---|---|
| Chrome-magnesite | 99 |
| Formic acid | 1 |

The sand was prepared by stirring the mixture of the refractory filler and formic acid for 1–2 min.

Standard samples were made from the resultant sand by charging the latter into blocks and its subsequent compacting.

The standard samples were tested for compressive strength which was 4.0 kg/cm$^2$ after 1 hour; 5.5 kg/cm$^2$ after 4 hours; and 8.0 kg/cm$^2$ after 24 hours.

EXAMPLE 2

A sand was prepared from the following components, in percent by weight:

| | |
|---|---|
| Chrome-magnesite | 97 |
| Formic acid | 3 |

The sand was prepared by stirring the mixture of the refractory filler and formic acid for 1–2 min.

The standard samples from the sand were tested for compressive strength, which was 14.0 kg/cm$^2$ after 1 hour; 19 kg/cm$^2$ after 4 hours; and 23.5 after 24 hours.

EXAMPLE 3

A sand was prepared from the following components, in percent by weight:

| | |
|---|---|
| Chrome-magnesite | 95 |
| Formic acid | 5 |

The sand was prepared by stirring the mixture of the refractory filler and formic acid for 1–2 min.

The standard samples from the resultant sand were tested for compressive strength, which was 16.5 kg/cm$^2$ after 1 hour; 21.0 kg/cm$^2$ after 4 hours; and 26.5 kg/cm$^2$ after 24 hours.

EXAMPLE 4

A sand was prepared from the following components, in percent by weight:

| | |
|---|---|
| Magnesite-chrome | 97 |
| Formic acid | 3 |

The sand was prepared by stirring the mixture of refractory filler and formic acid for 1–2 min.

The standard samples from the sand were tested for compressive strength, which was 15.0 kg/cm$^2$ after 1 hour; 19.0 kg/cm$^2$ after 4 hours; and 23.5 kg/cm$^2$ after 24 hours.

EXAMPLE 5

A sand was prepared from the following components, in percent by weight:

| | |
|---|---|
| Chrome ironstone | 97 |
| Benzenesulfonic acid | 3 |

The sand was prepared by stirring the mixture of refractory filler and acid for 1–2 min.

The standard samples from the resultant sand were tested for compressive strength, which was 14.5 kg/cm$^2$ after 1; 17.0 kg/cm$^2$ after 4 hours; and 22.5 kg/cm$^2$ after 24 hours.

EXAMPLE 6

A sand was prepared from the following components, in percent by weight:

| | |
|---|---|
| Chrome-magnesite | 48.5 |
| Magnesite chrome | 48.5 |
| Maleic acid | 3 |

The sand was prepared by stirring the mixture of the refractory filler and acid for 1–2 min.

The standard samples from the resultant sand were tested for compressive strength, which was 15.5 kg/cm$^2$ after 1 hour; 20.0 kg/cm$^2$ after 4 hours; and 24.5 kg/cm$^2$ after 24 hours.

EXAMPLE 7

A sand was prepared from the following components, in percent by weight:

| | |
|---|---|
| Quartz sand | 82 |
| Magnesium oxides | 15 |
| Acetic acid | 3 |

The sand was prepared by stirring the mixture of the refractory filler (a mixture of quartz sand and magnesium oxides) and acid for 1–2 min.

The standard samples made from the sand were tested for compressive strength, which was 14.5 kg/cm$^2$ after 1 hour; 17.0 kg/cm$^2$ after 4 hours; and 22.0 kg/cm$^2$ after 24 hours.

EXAMPLE 8

A sand was prepared from the following components, in percent by weight:

| | |
|---|---|
| Chrome-magnesite | 97 |
| Maleic acid | 1.5 |
| Orthophosphoric acid | 1.5 |

The sand was prepared by stirring the mixture of the refractory filler and acids for 1–2 min.

The standard samples made from the resultant sand were tested for compressive strength, which was 13.0 kg/cm$^2$ after 1 hour; 16.5 kg/cm$^2$ after 4 hours; and 22.0 kg/cm$^2$ after 24 hours.

EXAMPLE 9

A sand was prepared from the following components, in percent by weight:

| | |
|---|---|
| Chrome-magnesite | 96.7 |
| Maleic acid | 3.0 |
| Orthophosphoric acid | 0.3 |

The sand was prepared by stirring the mixture of the refractory filler and acids for 1–2 min.

The compressive strength of the standard samples made from the resultant sand was 15.0 kg/cm$^2$ after 1 hour; 18.0 kg/cm$^2$ after 4 hours; and 23.5 kg/cm$^2$ after 24 hours.

EXAMPLE 10

A sand was prepared from the following components, in percent by weight:

| | |
|---|---|
| Chrome-magnesite | 97 |
| Maleic acid | 0.6 |
| Orthophosphoric acid | 2.4 |

The resultant mixture of the refractory filler and acids was stirring for 1–2 min.

The compressive strength of the standard samples made from the resultant sand was 6.5 kg/cm$^2$ after 1 hour; 11.0 kg/cm$^2$ after 4 hours; and 26.0 kg/cm$^2$ after 24 hours.

EXAMPLE 11 (COMPARATIVE)

Table 3 gives the residual compressive strength data for the prior-art sand (comprising 94 parts by weight of quartz sand used as a filler; 6 parts by weight of powdered ferrous oxide; and 6 parts by weight of orthophosphoric acid) and for the sand according to the present invention.

TABLE 3

| Temperature, °C. | Compressive strength, kg/cm$^2$ | | | | | | | |
|---|---|---|---|---|---|---|---|---|
| | 20 | 200 | 400 | 600 | 800 | 1000 | 1200 | 1400 |
| Prior-art sand | 13 | 5.6 | 5.0 | 4.5 | 2.0 | 1.1 | 11.6 | 13.0 |

TABLE 3-continued

| Temperature, °C. | Compressive strength, kg/cm$^2$ | | | | | | | |
|---|---|---|---|---|---|---|---|---|
| | 20 | 200 | 400 | 600 | 800 | 1000 | 1200 | 1400 |
| Sand according to the invention as illustrated in Example 3 | 18 | 2.4 | 1.6 | 1.0 | 0.6 | 0.4 | 0.4 | 5.2 |

INDUSTRIAL APPLICABILITY

Cores and moulds from the cold setting sand of the invention may be used for the production of castings from steel, cast-iron and nonferrous alloys.

We claim:

1. A cold setting sand comprising:

from 95 to 99 weight percent of a refractory filler containing magnesium oxides, iron oxides, silicon oxides or mixtures thereof and from 1 to 5 weight percent of an organic acid having a dissociation constant of $10^{-5}$ to $10^{1}$.

2. The sand of claim 1, also containing orthophosphoric acid in a ratio to said organic acid of 0.1:1 to 4:1.

3. The sand of claim 1, wherein said aromatic acid is a carboxylic acid or a sulfonic acid.

4. The sand of claim 1, wherein said filler contains from 2 to 100 percent by weight of said oxides.

5. The sand of claim 1, wherein said filler consists of chrome-magnesite, magnesite chrome or chrome-ironstone.

6. The sand of claim 1, wherein 5.0 to 100.0 percent by weight of said oxides have a particle size less than 0.1 mm.

7. A sand according to claim 1 comprising 95 to 99 percent by weight of chrome magnesite and 1 to 5 percent by weight of formic acid.

8. A sand according to claim 1 comprising 97 percent by weight of chrome-ironstone and 3 percent by weight of benzenesulfonic acid.

9. A sand according to claim 1 comprising 48.5 percent by weight each of chrome-magnesite and magnesite chrome and 3 percent by weight of maleic acid.

10. A sand according to claim 1, comprising 82 percent by weight of quartz sand, 15 percent by weight of magnesium oxides and 3 percent by weight of acetic acid.

11. A sand according to claim 1 comprising in weight percent:

| | |
|---|---|
| Chrome-magnesite | 97, |
| Maleic acid | 1.5 and |
| Orthophosphoric acid | 1.5. |

12. A sand according to claim 1, comprising in weight percent:

| | |
|---|---|
| Chrome-magnesite | 96.7, |
| Maleic acid | 3.0 and |
| Orthophosphoric acid | 0.3. |

13. A sand according to claim 1, comprising in weight percent:

| | |
|---|---|
| Chrome-magnesite | 99 and |

-continued

| | |
|---|---|
| Formic acid | 1. |

14. A sand according to claim 1, comprising in weight percent:

| | |
|---|---|
| Chrome-magnesite | 97 and |
| Formic acid | 3. |

15. A sand according to claim 1, comprising in weight percent:

| | |
|---|---|
| Chrome-magnesite | 95 and |
| Formic acid | 5. |

16. A sand according to claim 1, comprising in weight percent:

| | |
|---|---|
| Quartz sand | 82, |
| Magnesium Oxides | 15 and |
| Acetic acid | 3. |

17. A sand according to claim 1, comprising in weight percent:

| | |
|---|---|
| Chrome-magnesite | 48.5, |
| Magnesite chrome | 48.5 and |
| Maleic acid | 3. |

18. A sand according to claim 1, comprising in weight percent:

| | |
|---|---|
| Chrome ironstone | 97 and |
| Benzenesulfonic acid | 3. |

19. A sand according to claim 1, comprising in weight percent:

| | |
|---|---|
| Magnesite-chrome | 97 and |
| Formic acid | 3. |

20. A sand according to claim 1, comprising in weight percent:

| | |
|---|---|
| Chrome-magnesite | 97, |
| Maleic acid | 0.6 and |
| Orthophosphoric acid | 2.4. |

* * * * *